United States Patent [19]

Christensen

[11] 3,948,398

[45] Apr. 6, 1976

[54] SELF-LOCKING LOG SKIDDING CARRIAGE

[75] Inventor: Donald E. Christensen, Orofino, Idaho

[73] Assignee: David Gladhart, Pierce, Idaho ; a part interest

[22] Filed: Jan. 27, 1975

[21] Appl. No.: 544,355

[52] U.S. Cl. ..... 212/122; 188/44; 212/94; 254/139.1

[51] Int. Cl.[2] ..... B66C 21/00

[58] Field of Search..... 254/139.1, 183, 147; 212/86, 94, 102, 104, 105, 108, 109, 116, 122, 78, 83, 87, 97; 188/43, 44

[56] References Cited

UNITED STATES PATENTS

| | | | |
|---|---|---|---|
| 1,504,753 | 8/1924 | Guerin | 212/97 |
| 2,649,209 | 8/1953 | Wilson | 212/122 |

*Primary Examiner*—Robert J. Spar
*Assistant Examiner*—Lawrence J. Oresky
*Attorney, Agent, or Firm*—Wells, St. John & Roberts

[57] ABSTRACT

A self-locking log skidding carriage for skidding logs uphill along a skyline to a powered skidding machine. The carriage includes two freely rotatable sheaves, a first for engaging a taut skyline, and a second for rotatable engagement with a dragline commonly utilized for skidding and hauling logs from one point to another. A locking wheel is positioned between the two sheaves and is actuated by members positioned on the skyline and dragline. The first actuator member on the skyline operates the locking wheel of the carriage in response to gravitational movement of the carriage down the skyline. As the carriage engages the first actuating member, the locking wheel is moved to lock the carriage to the first actuating member and to release the dragline from a previously locked position. The dragline is then free to be pulled outward from the carriage in substantially any direction to be secured to a log or group of logs. The skidding machine may then be operated to retract the dragline over the second sheave. The carriage is locked to the skyline and first actuating member, so the dragline will move over the second sheave to pull the log or logs toward the carriage. A second actuator member on the end of the dragline eventually comes into contact with the locking wheel, moving it back to its skidding position to lock the carriage to the dragline and unlock the carriage from the skyline. Once this is accomplished, the skidding machine may be utilized to pull both the carriage and engaged log up the grade to a landing.

5 Claims, 4 Drawing Figures

SELF-LOCKING LOG SKIDDING CARRIAGE

BACKGROUND OF THE INVENTION

The present invention is related basically to skidding carriages and more particularly to self-locking skidding carriages.

It has long been the practice of loggers, when operating in steep terrain, to station a skidding machine at an elevated position adjacent to a landing where logs are loaded onto trucks for transportation to a sawmill. A dragline is either thrown or manually hauled from a winch drum on the skidding machine to the location where trees have been cut. A choker or grapple at the end of the dragline is then fixed about the circumference of a log. The dragline is then retracted toward the skidding machine and the log is dragged along the ground to the landing area.

Another method presently being utilized is a balloon or helicopter hoist type operation wherein a choker or grab at the end of a long cable is connected to a log or logs to be lifted upwardly by the balloon or helicopter and moved to a landing area. Although this is a rather clean operation, it is extremely expensive for the logging contractor.

Another more recent development has been the utilization of skyline skidding wherein a carriage is moved up and down a taut skyline stretched between a boom and a stationary anchor point located downhill from the landing. A dragline is normally carried by the carriage along the skyline down the hill to a position slightly uphill of the anchor point. A person known as a "choker setter" then hauls the dragline and grapple or choker from the carriage to the cut logs. He connects the grapple or choker to a log and signals an operator in the skidding machine. The dragline is then pulled toward the carriage and subsequently towed up the hill with the forward end of the log lifted off the ground with only the tail or downhill end dragging along the ground. This type of operation is not only less detrimental to the environment than conventional skidding, but is relatively inexpensive for the logging contractor to initiate and utilize.

The carriage of the present invention automatically locks at the lower position adjacent the anchor point in order that logs may be pulled toward the carriage from substantially any direction, not necessarily in alignment with the skyline. Further, once the logs have been hauled to the carriage, the locking mechanism is automatically released and the carriage and logs are pulled up the grade to the landing. At the landing, the boom may be lowered or the skyline slackened to lower the logs to the landing and allow the logs to be unhooked from the dragline.

BRIEF SUMMARY OF THE INVENTION

A self-locking carriage is described for operation on a skyline and dragline. It comprises first and second sheaves rotatably mounted about parallel spaced axes within a framework. A pin is fixed to the framework between the first and second sheaves along an axis parallel to the sheave axes. A slotted locking wheel is mounted to the pin for pivotal movement about the pin axis and sliding movement along a plane perpendicular to the pin axis. A pawl is included on the slotted locking wheel that is designed to engage a stationary abutment on the framework. Spring means is operatively connected between the pin and pawl to normally urge the pawl radially away from the pin. A stop means is also provided, interconnected between the locking wheel and framework. The stop means restricts pivotal movement of the locking wheel and pawl about the pin axis. In a first position, the pawl is engaged on one side of the stationary abutment. The skyline is then operatively clamped between the first sheave and locking wheel. In the second position, the pawl is engaged on an opposite side of the abutment and the dragline is operatively clamped between the second sheave and locking wheel. A first actuator means is provided that is rigidly mountable to the skyline. The first actuator means becomes engaged between the locking wheel and the first sheave to forcibly move the locking wheel and pawl to the second position from the first position. In this position, the skyline is locked against movement between the locking wheel and first sheave and the dragline is released for free movement over the second sheave. A second actuator means is rigidly mountable to the dragline for engaging the locking wheel to forcibly move it to the first position from the second position. This movement is accomplished in response to movement of the second actuator means between the second sheave and locking wheel. In this position, the dragline is locked against movement between the locking wheel and second sheave and the skyline is released for free movement over the second sheave.

It is a principal object of my invention to provide a carriage that is capable of automatically locking and unlocking itself alternately to a skyline and dragline in order to facilitate lateral skidding of logs relative to the orientation of a skyline.

A further object is to provide such a carriage that is very simple in construction and thereby relatively maintenance free and inexpensive to manufacture.

These and further objects and advantages will become apparent upon reading the following description which, taken with the accompanying drawings, discloses a preferred embodiment of my invention.

DETAILED DESCRIPTION OF A PREFERRED EMBODIMENT

Figures 1, 2, 3, 4:
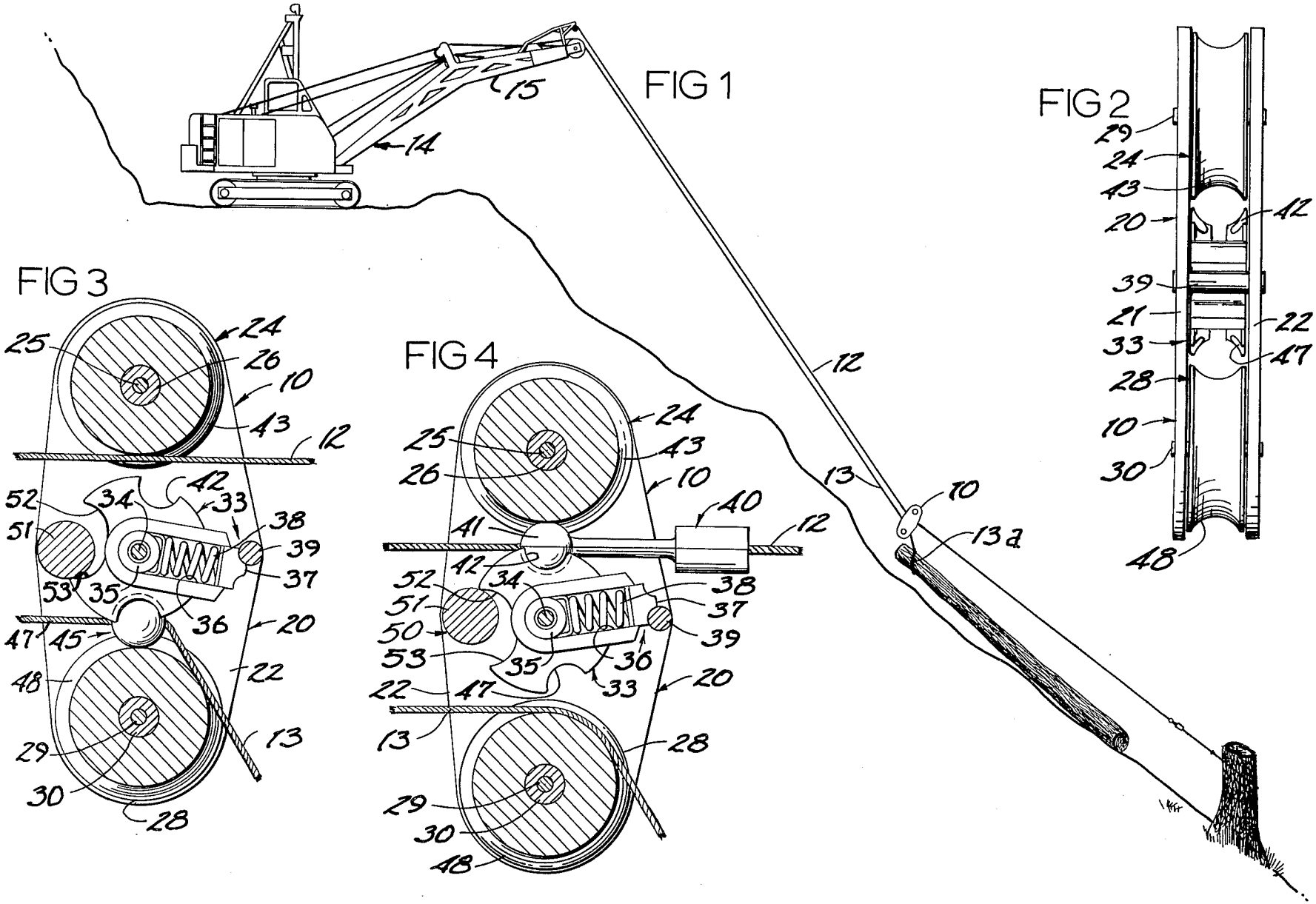
FIG. 1 is a pictorial schematic illustrating operation of the present invention in conjunction with a skidding machine.
FIG. 2 is more detailed front elevational view of the preferred form of my invention.
FIG. 3 is a cross-sectional side view shown with a skyline and dragline.
FIG. 4 is a section view similar to FIG. 3, illustrating a different operational position of the carriage elements.

A carriage embodying a preferred form of my invention is illustrated in the accompanying drawings and is designated therein by the reference character 10. It is preferably intended that the carriage 10 be utilized in logging operations to enable logs to be moved from a downhill location to an elevated landing for loading onto trucks. Carriage 10 is utilized with a skyline 12 and dragline 13 having a choker or grab 13*a* at one end thereof. The skyline and dragline 12 and 13 are operatively connected to a skidding machine schematically shown at 14. As shown, a drum crane may be utilized for this purpose having an outwardly projecting boom 15.

Prior to operation, the skyline 12 is connected at the lower end to an anchor point, usually a tree trunk or stump. The skyline 12 is drawn to a taut condition in order to allow the carriage 10 to move freely along the length of skyline 12 between boom 15 and the anchor point and to provide support for logs engaged by the dragline 13.

Referring now in greater detail to the elements comprising my invention, reference will be made in particular to FIGS. 2–4. As shown, carriage 10 basically includes a framework 20 rotatably mounting a first sheave 24, a second sheave 28 and a locking wheel 33. The framework 20 is shown as being comprised of two spaced plates 21 and 22. The first sheave 24 is freely rotatably mounted between plates 21 and 22 by a pin 25 and bearing 26. Pin 25 locates first sheave 24 within the framework 20 for rotation about a fixed axis. Second sheave 28 is likewise mounted within framework 20 between plates 21 and 22 by a pin 20 and bearing 30. Pin 20 is mounted on fixed axis parallel to the axis of pin 25.

The locking wheel 33 is mounted between the first and second sheaves 24 and 28. Locking wheel 33 is pivotably mounted about the axis of a pin 34 extending between plates 21 and 22. Pin 34 rotatably mounts a bearing 35 which, in turn, is slidably carried within a U-shaped channel 36 formed in locking wheel 33. A pawl 37 is affixed to the locking wheel 33 and spans the outer radial end of channel 36. The open space within channel 36 between pawl 37 and bearing 35 is occupied by a compression spring 38. It may be understood from viewing FIGS. 3 and 4 that the compression spring will allow the locking wheel 33 to slide over bearing 35 along a plane perpendicular to the axis of pin 34. Bearing 35 also enables the locking wheel to pivot freely about the axis of pin 34. This pivotal and slidable freedom of locking wheel 33 enables movement of pawl 37 from one side of a first abutment 39 to the other (FIGS. 3, 4).

Pawl 37 is located for operative engagement with a first abutment or stop 39. Stop 39 is fixed between plates 21 and 22 slightly radially inward of the outer end of pawl 37 with respect to the axis of pin 34. The stop 39 is located in the pivot path of the pawl to restrict its movement about the pin axis. Locking wheel 33 is movable, however, between a first position as shown in FIG. 3 and a second position as shown in FIG. 4 wherein the pawl 37 is located on opposite sides of the stop 39. This movement is caused by a first actuator means 40 and a second actuator means 45.

First actuator means 40 is comprised of a ball 41 that is releasably mounted to the skyline 12. The manner of clamping ball 41 to skyline 12 is immaterial to this disclosure. It is essential that the ball 41 be movable along the skyline in order that it be selectively placed at different positions along the skyline during the skidding procedure. The ball 41 is received, as the carriage moves gravitationally down the skyline, by a recess 42 located in locking wheel 33. Recess 42 is complementary to a portion of ball 41 and will pivot with wheel 33 about the axis of pin 34 when forcibly engaged by the relatively stationary ball 41 as the carriage is moved along skyline 12. First sheave 24 also includes a peripheral complementary configuration 43 that receives a portion of ball 41 therein.

In operation, the carriage descends gravitationally from the landing toward the anchor point in the condition as shown in FIG. 3 with the first sheave 24 freely rolling along the skyline 12. The first actuator means 40 is engaged, as the carriage reaches the desired location, to push the locking wheel away from stop 39 and compress the spring 38. During this compressed condition the pawl 37 is located radially inward (with respect to the axis of pin 34) of the stop 39. Since stop 39 no longer presents a restriction for pivotal movement of pawl 37, the continued downward gravitational force of the carriage forces the ball further between the first sheave 24 and locking wheel 33 to pivot the pawl 37 upwardly as is indicated by the arrow in FIG. 4 to the opposite side of stop 39. In this position, the skyline is locked to the carriage through actuator means 40. Dragline 13 is simultaneously released from engagement between the locking wheel 33 and second sheave 28.

The second actuator means 45 is also provided in the shape of a ball for selectively locking the dragline 13 against movement relative to carriage 10. Second actuator means 45 may be secured to the drag line 13 by means similar to that for securing actuator 40. Preferably the acutator means 45 is connected in stationary relation with the dragline 13 adjacent the grab or choker **13*a***.

The locking wheel 33 includes a second recess 47 that is complementary in configuration to a portion of the second actuator ball 45. In addition, the second sheave 28 includes a complementary surface 48 that is also designed to receive a portion of the ball 45. As shown in FIGS. 3 and 4, the recess 47 is angularly spaced from the first recess 42 about the locking wheel axis so that in the first position, (FIG. 3) the axes of the first and second sheaves 24 and 28, the axis of pin 34, and the center of recess 47 are aligned. In the second position, (FIG. 4) the sheave axes, pin 34 axis, and center of the first recess 42 are all aligned.

As carriage 10 is gravitationally moved down the incline, (FIG. 1) locking wheel 33 is located in the first position as shown in FIG. 3. The dragline 13, in this position, is locked between the locking wheel 33 and second sheave 28. Once the first actuator 40 comes into engagement with locking wheel 33 and first sheave 24, wheel 33 is pivoted to the second position, releasing ball 45 and allowing the dragline 13 to move freely over the second sheave 28. This permits the dragline and grab or choker **13*a* to be pulled laterally to engage the next log. As the dragline is subsequently retracted toward the skidding machine, ball 45 again becomes engaged between the second sheave and locking wheel 33, within recess 47 and complementary surface 48. As the dragline continues toward the skidding machine, actuator ball 45 pushes the wheel 33 back to compress spring 38 and move the pawl 37 inwardly of first abutment 39. As the ball is pulled further toward the skidding machine 14, the wheel and pawl pivot to the first position with pawl 37 then located at the other side of abutment 39**.

A second stop means 50 is provided and is illustrated in FIGS. 3 and 4. Stop means 50 is utilized to restrict the amount of pivotal movement and lateral movement of wheel 33 and pawl 37 relative to the axis of pin 34. Stop means 50 is comprised of a second abutment 51 mounted between plates 21 and 22. The locking wheel 33 includes opposed arcuate abutment surfaces 52 and 53 that straddle the second abutment 51 and are located thereon to restrict pivotal movement of wheel 33 between the first and second positions previously described. Engagement of the second abutment 51 by one of the surfaces 52 and 53 and similar engagement of the first abutment 39 by pawl 37 assures a locked condition; in the first position, of dragline 13; and in the second position of skyline 12 relative to the carriage.

In operation, the skyline 12 is first extended from boom 15 and anchored at an appropriate location as schematically indicated in FIG. 1. The skyline 12 is then pulled taut so the carriage may move gravitationally down the skyline through engagement between skyline 12 and first sheave 24. As the carriage reaches the location of first actuator 40, ball 41 enters carriage between recess 42 and first sheave 24. Force of the stationary ball against the locking wheel 33 compresses the spring 38 and pivots the wheel 33 upwardly to move pawl 37 to the opposite side of the first abutment 39. The second actuator ball 45 is simultaneously released as the wheel 33 pivots, enabling free movement of dragline 13 over second sheave 28. The choker or grab 13*a* is then positioned on a log and the machine operator is signaled to begin taking in the dragline. As the dragline is retracted, the second actuator ball 45 forcibly engages recess 47 to compress spring 38 and move pawl 37 downwardly over abutment 39 to its opposite side. This locks the ball 45 and dragline 13 relative to carriage 10. In this locked condition, the carriage and attached log are drawn up the incline to a landing by the retracting dragline. At the landing, the log is lowered simply by releasing tension on the skyline to lower carriage 10, or by lowering boom 15 to likewise lower the carriage. Once the log rests completely on the ground and the dragline is slack, the choker or grab 13*a* may be released from the log. The carriage may then be sent back down the skyline to receive the next successive log.

It should be understood that the above description and attached drawings are given simply by way of example, it being understood that various changes and modifications may be made therein without departing from the intended scope of my invention. Therefore, only the following claims are to be taken as definitions of my invention.

What I claim is:

1. A self-locking log skidding carriage for operation on a skyline and dragline, comprising:

a framework;

a first sheave mounted to the framework for free rotation thereon about a first axis and for operative engagement with a skyline;

a second sheave mounted to the framework for free rotation thereon about a second axis spaced from the first axis and for operative engagement with a dragline;

a pin fixed to the framework between the first and second sheave having a pin axis parallel to the axes of the first and second sheave;

a slotted locking wheel mounted to the pin for pivotal movement about the pin axis and sliding movement over the pin along a plane perpendicular to the pin axis;

a pawl fixed to the locking wheel;

a stationary abutment on the framework for engagement with said pawl;

spring means operatively connected between the pin and pawl for urging the pawl radially away from the pin;

stop means interconnecting the locking wheel and framework for restricting pivotal movement of the locking wheel and pawl about the pin axis between a first position wherein the pawl is engaged on one side of said abutment and the skyline is operatively clamped between the first sheave and locking wheel and a second position wherein the pawl is engaged on an opposite side of said abutment and the dragline is operatively clamped between the second sheave and locking wheel;

a first actuator means rigidly mountable to the skyline for engaging the locking wheel and forcibly moving the locking wheel and pawl to the second position from the first position in response to movement of the first actuator means between the first sheave and the locking wheel, to lock the skyline against movement between the locking wheel and first sheave and release the dragline for free movement over the second sheave;

second actuator means rigidly mountable to the dragline for engaging the locking wheel and forcibly moving the locking wheel and pawl to the first position from the second position in response to movement of the second actuator means between the second sheave and locking wheel, to lock the dragline against movement between the locking wheel and second sheave and release the skyline for free movement over the second sheave.

2. The carriage as defined in claim 1 wherein the first actuating means is comprised of a first ball releasably mountable to the skyline and wherein the locking wheel includes a first ball receiving recess complementary to a portion of the first ball; and said recess being located on said locking wheel so that the axes of the first sheave, the pin axis and the center of the first recess are aligned and the first ball is engaged between the locking wheel and the first sheave when the locking wheel is located in the second position.

3. The carriage as defined in claim 2 wherein the second actuating means is comprised of a second ball releasably mountable to the dragline and wherein the locking wheel includes a second ball receiving recess complementary to a portion of the second ball and is located thereon so the axis of the second sheave, the pin axis, and center of the second recess are aligned and the second ball is engaged between the locking wheel and the second sheave when the locking wheel is in the first position.

4. The carriage as defined in claim 3 wherein the stop means is comprised of;

a second stationary abutment fixed to the framework adjacent the locking wheel; and wherein the locking wheel includes a pair of abutment surfaces thereon located on opposite sides of the second stationary abutment, angularly spaced apart so one surface contacts the stationary abutment when the locking wheel is in the first position and the remaining surface contacts the stationary abutment when the locking wheel is in the second position.

5. The carriage as defined in claim 3 wherein the first and second sheaves include circumferential configurations complementary to portions of the first and second balls respectively.

* * * * *